US010208526B1

(12) United States Patent
Martin

(10) Patent No.: US 10,208,526 B1
(45) Date of Patent: Feb. 19, 2019

(54) DECORATIVE COVER FOR COMMERCIAL WINDOW FRAMES

(71) Applicant: Richard E. Martin, Longwood, FL (US)

(72) Inventor: Richard E. Martin, Longwood, FL (US)

( * ) Notice: Subject to any disclaimer, the term of this patent is extended or adjusted under 35 U.S.C. 154(b) by 0 days.

(21) Appl. No.: 15/417,382

(22) Filed: Jan. 27, 2017

Related U.S. Application Data

(60) Provisional application No. 62/287,732, filed on Jan. 27, 2016.

(51) Int. Cl.
*E06B 1/34* (2006.01)
*E06B 3/96* (2006.01)

(52) U.S. Cl.
CPC ..... *E06B 1/345* (2013.01); *E06B 1/34* (2013.01); *E06B 3/96* (2013.01)

(58) Field of Classification Search
CPC . E06B 1/34; E06B 1/342; E06B 1/345; E06B 3/96; E06B 3/964
See application file for complete search history.

(56) References Cited

U.S. PATENT DOCUMENTS

| | | | | | |
|---|---|---|---|---|---|
| 3,609,928 | A * | 10/1971 | Mock | E06B 1/30 | 49/505 |
| 4,281,481 | A * | 8/1981 | Wendt | E06B 1/18 | 49/504 |
| 5,222,343 | A * | 6/1993 | Anderson | E04F 19/061 | 52/211 |
| 6,684,572 | B2 * | 2/2004 | Homolka | E06B 1/34 | 49/462 |
| 7,036,283 | B2 * | 5/2006 | Halas | E06B 1/34 | 52/311.1 |
| 7,340,866 | B1 * | 3/2008 | Smith | E06B 1/003 | 52/204.54 |
| 7,770,352 | B2 * | 8/2010 | Plasek | E04F 19/02 | 52/211 |
| 8,490,350 | B1 * | 7/2013 | Greely | E06B 1/34 | 52/211 |
| 9,428,921 | B2 * | 8/2016 | Hawk | E06B 3/9645 | |
| 9,803,352 | B2 * | 10/2017 | Gosling | E04B 1/40 | |
| 2009/0064609 | A1 * | 3/2009 | Ouyang | E04F 19/0495 | 52/211 |

* cited by examiner

*Primary Examiner* — Andrew J Triggs
(74) *Attorney, Agent, or Firm* — Terry M. Sanks, Esq.; Beusse Wolter Sanks & Maire, PLLC

(57) ABSTRACT

An apparatus for reviving the appearance of a frame structure in a commercial window utilizes extruded plastic U-shaped channels adapted to fit over each element of the frame structure. The plastic channels are mixed with a selected color so that no painting is required. The channels are preferably attached to the frame structure by adhesive strips. Ends of the channels at frame structure intersections are covered by connectors overlaying ends of the channels.

20 Claims, 3 Drawing Sheets

DECORATIVE COVER FOR COMMERCIAL WINDOW FRAMES

CROSS-REFERENCE TO RELATED APPLICATIONS

This application claims the benefit of U.S. Provisional Application No. 62/287,732 filed Jan. 27, 2016, and incorporated herein by reference in its entirety.

BACKGROUND OF THE INVENTION

The present invention relates to display windows for buildings and retail stores and, more particularly, to a decorative cover system and method for creating a different appearance of such display windows using a removable plastic cover over the frame structure for such windows.

Display windows for shops, retail stores and the lower level entry areas of other commercial buildings are generally custom designed with metal frame members supporting large glass sheets of different sizes. The frame members are typically aluminum extrusions and may have slightly different cross-section dimensions depending upon the architectural design desired. The length of each extrusion will also depend on the particular design of the display window. As part of the manufacturing process, the frame members are usually colored with a semi-permanent powder coating. Since the frame members are designed for long life, the coloring for the frame members is usually something that is relatively bland such as white, black or an off-white cream color. If it is ever desired to change the color of the frame members in order to give the display window a fresher look, the process of re-painting the frame members is not always effective since the new paint does not always adhere well to the powder coated members and can fleck off in spots or areas. Further, paint applied to frame members tends to fade unevenly and result in a blotchy appearance of the members that distracts from the desired attractiveness of the display window. What is needed, therefore, is a method and apparatus that will allow frame members to take on a different color or other appearance that will appear fresh and attractive and that can be changed when desired to create a fresh look to the display window.

SUMMARY OF THE INVENTION

The present invention is directed to a method and apparatus that can be used with extruded aluminum frame members for a window or door to cover the existing frame members to refurbish the existing frame members and provide a fresh look and color change to the frame members. In a preferred form, the invention comprises an extruded plastic U-shaped channel sized to fit snugly about an existing frame member of a window or door of a commercial building. The channel can be formed of a colored plastic material that is UV resistant to inhibit deterioration and color fading, such as a polycarbonate with a UV inhibitor. In one form, the channel may have internal fins or ridges that project inwardly to grip the frame member and hold the channel in position. Alternately, the channel may be attached to the frame member by double-sided tape, hook-and-loop material or an adhesive. The apparatus may also be formed in an L-shaped cross-section for use in overlaying frame members around an outer periphery of a display window when the frame member abuts against another structure.

In addition to the decorative function, the plastic channels can be formed with sufficient thickness so as to act as a thermal barrier over the aluminum frame members. A thickness of about one millimeter will provide sufficient structural integrity and thermal insulation to achieve this desirable effect. Further, the will enhance the appearance of the window frames by covering and concealing dings, dents, scratches and holes in the metal frame.

DETAILED DESCRIPTION

Figure 1:
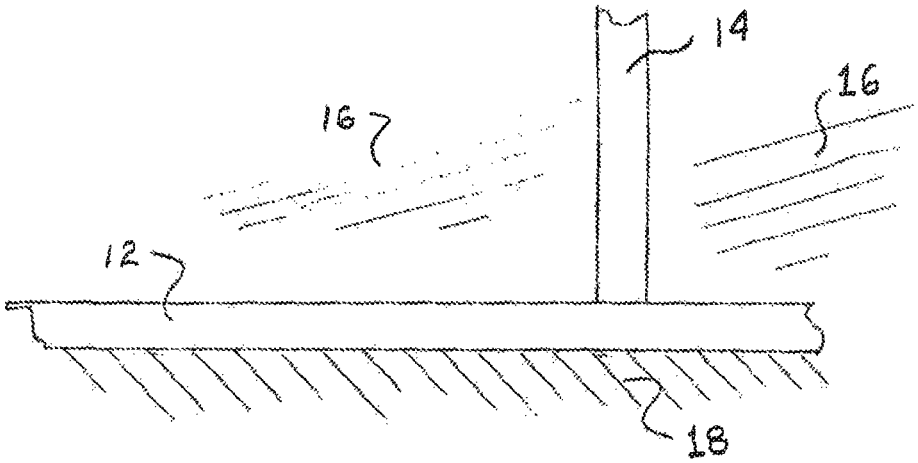
FIG. 1 is a partial plan view of a section of a display window showing the arrangement of frame members and glass.

Referring to FIG. 1, a typical display window for a commercial building comprises a combination of horizontal frame members, such as the frame member 12, and vertical frame members, such as the frame member 14. These frame members support glass sheets indicated generally at 16. Such frame members are well known in the art and are structured with grooves or other means for supporting the glass sheets. Each of the frame members 12, 14 are commonly extruded aluminum structures having a conventional cross-sectional configuration and size, although there may be some variation in the configuration and size. The glass sheets are normally inset toward the building so that a portion of the frame members protrude forwardly of the glass sheet but generally co-planar with an outer surface of the building indicated by lines 18.

The aluminum material of the frame members is protected by and colored by a powder coating that is baked onto the material. It is believed that the only way to re-finish or change the color of the frame members 12, 14 is to have the members painted using conventional brush on or spray on paint. In other words, it is not cost-effective to disassemble the window structure in order to refinish the frames using conventional powder coating. Painting of the frames in-situ is not desirable since conventional paint does not adhere strongly to the frames and tends to fade and to chip from the aluminum frame members. The present invention overcomes the undesirable aspects of painting by providing a fitted pre-formed structure in the form of a plastic channel that can be placed over the exposed portion of the frame members and provide a more pleasing appearance to the display window. While the term "plastic" is used in a generic sense, it will be appreciated that the channel may be formed from a vinyl or polyvinyl or acrylic material or other extrudable material that can be colored and have shape retention. In a preferred form, the plastic material is a polycarbonate material. Although not anticipated, it is possible to create a channel of extruded aluminum that could be attached over the existing frame members and the term plastic should be interpreted in its broadest sense to include such an alternative structure. However, aluminum has the disadvantage of not being susceptible to the addition of color into the plastic prior to extrusion and it is often desirable to be able to create a frame structure of different colors with UV protection that will not rapidly fade with extended exposure to sunlight. However, such aluminum channels could be powder coated in the same manner as the aluminum frame members. Another downside of using aluminum or other metal channels is the cost associated with manufacturing the product and the aluminum does not have the same stain resistant characteristics as the plastic material where the color is an integral part of the product. Since the plastic channels are colored by mixing the colorant into the plastic, scratches in the surface are not so visible since the color extends through the plastic material of the channel. Plastic material is also lightweight when compared to metal and therefore more convenient to handle and requires less structural support to put and be held in place over the aluminum frame structures. Another advantage of using plastic is that the material is easily extruded in a desired size to fit over existing aluminum frame members. Fortunately, aluminum frame members in commercial store fronts are generally the same in cross-section dimensions so that very few different sizes of plastic channels are needed to fit existing store fronts.

Figure 2:
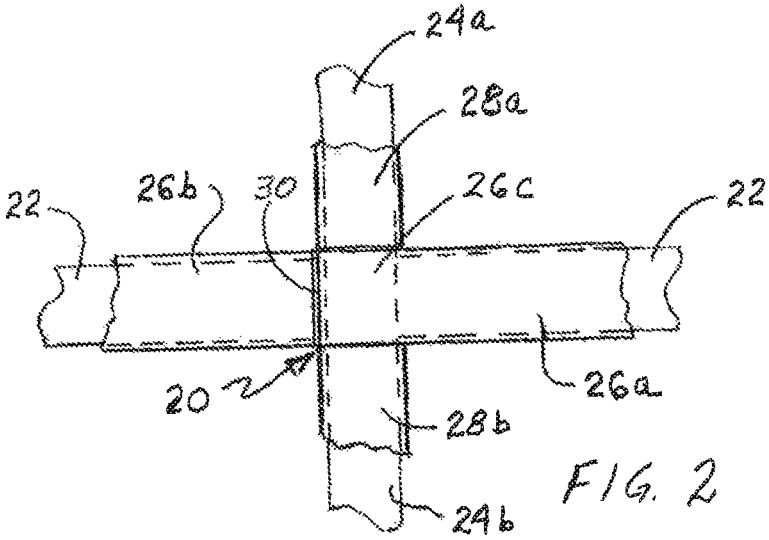
FIG. 2 is a plan view of a section of a display window showing the use of the present invention to overlay existing frame members.
Figure 2A:
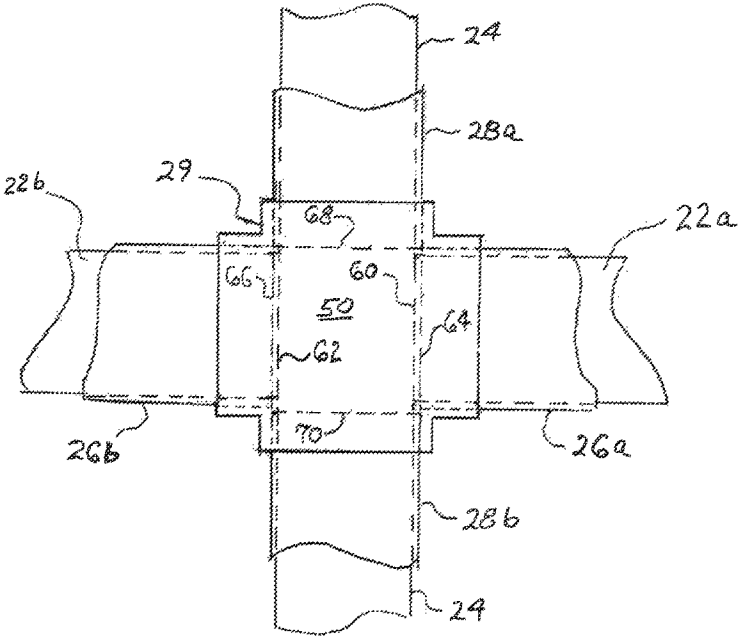
FIG. 2A is a plan view of the joint or frame structure of FIG. 2 with a decorative cover in place.

Referring to FIG. 2, there is illustrated one method of creating a junction 20 of frame members 22 and 24*a*, 24*b*. In this junction 20, the horizontal frame member 22 extends through the junction while the members 24*a*, 24*b* terminate at the junction. Each of the frame members is covered by a channel with the horizontal channel being formed of two components 26*a*, 26*b* and the vertical channel being formed of two components 28*a*, 28*b*. Since the channels are preferably formed of a plastic material, the ends of the channels may be cut on site to fit precisely about the frame members at junctions such as junction 20. In order to cover the frame members at the junction, the horizontal channel 26*a* has its side elements (not shown) cut away at the junction leaving only the top portion 26*c* extending across the width of the vertical frame member 24*a*. The channel 26*b* abuts against the extending portion 26*c* at edge 30 while the vertical channels 28*a*, 28*b* abut against opposite side edges of the portion 26*c*. This arrangement provides complete coverage of the frame members across junction 20 but is not as pristine as the junction shown in the top plan view of FIG. 2A. The junction of FIG. 2A is also easier to install since the vertical and horizontal channels 28, 26, respectively, need only to be cut-off so that each channel abuts the crossing frame member. The joint is then covered by a separate plastic connector member 29 (described hereinafter with reference to FIGS. 7, 8 and 9) that is sized to fit snugly about the joint and to have a portion overlaying the ends of the channels.

Figure 3:
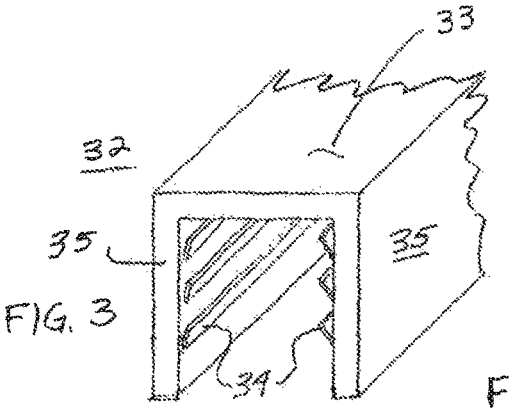
FIG. 3 is an end perspective view of one form of channel member in accordance with one aspect of the present invention.

Turning now to FIGS. 3, 4, 5 and 6 in combination, there are shown several different configurations of the present inventive channels that could be used in the structure shown in FIG. 2. FIG. 3 illustrates a perspective end view of a generally U-shaped channel 32 having a plurality of inner fins or protrusions 34 formed on opposing lateral sides 35 of the channel, the lateral sides extending generally perpendicular from a base 33 of the channel. This form of channel 32 could be pressed over a frame member, such as member 22, and the protruding fins 34 would grip the sides of the frame member to hold the channel in place. This type of channel would be easy to install and to remove since it does not use any other material to hold the channel in place. Further, the shape of the fins 34 could be such as to create a bond between the channel and frame member making it harder to remove the channel than to install it. The fins 34 would be formed in the die so that the fins are formed concurrently with extrusion of the channel through a die forming processing.

Figure 4:
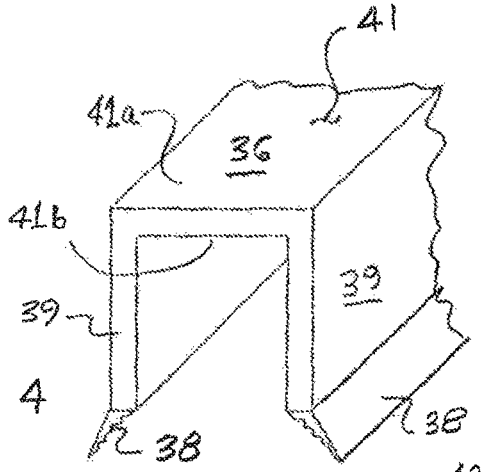
FIG. 4 is an end perspective view of one form of channel member in accordance with another aspect of the present invention.
Figure 5:
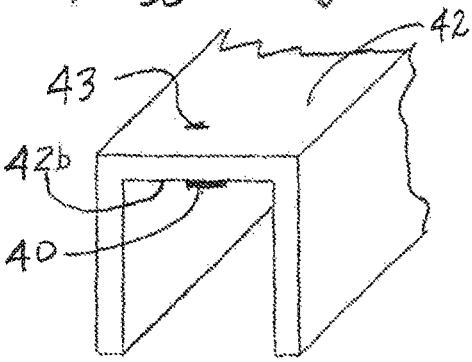
FIG. 5 is an end perspective view of one form of channel member in accordance with still another aspect of the present invention.

FIG. 4 is a perspective end view of another form of channel 36 having flexible side elements 38 extending from a lower edge of side members 39 so that the elements 38 can seat onto the glass sheet of the display windows and form a clean edge with a snug fit. The side members depend from a base member 41 having an outer surface 41*a* and an inner surface 41*b*. Although not shown, the channel 36 could also be formed with inner fins such as those shown in FIG. 3 at 34 for attaching the channel to a frame member. FIG. 5 illustrates an alternative attachment in the form of a hook and loop material 40 (such as Velcro®) affixed along an inner surface 42*b* of a base 42 of a channel 43 with a mating material affixed to a mating frame member (not shown). The material 40 could also be replaced with double-sided tape or some form of releasable adhesive of a type well known in the art. In practice, double-sided tape has been found to be an economical solution for attaching the channels 26, 28 to frame members 22, 24 by positioning the tape along the inner surface 42*b* (or 41*b*) of the base of the channel member 43. The double-sided tape does not have to be continuous but can be placed in spaced apart locations and still be effective to hold the channels to the frame members and also to make for easier removal of the channels if it is desired to replace them or to substitute different colors of channels. Attachment of the channel members to the frame members merely requires removing a protective covering from one surface of the tape so that the tape can be adhered to the channel member. At installation, the protective covering remaining on an opposite side of the tape is peeled away exposing the adhesive so that the channel member can be pressed onto the frame member where the double-sided tape will then hold the channel member in engagement with the frame member. The channel members can be changed at any time by pulling on the channel members to with sufficient force to cause the adhesive of the double-sided tape to release. Any residue of the adhesive is easily removed with common chemicals.

Figure 6:
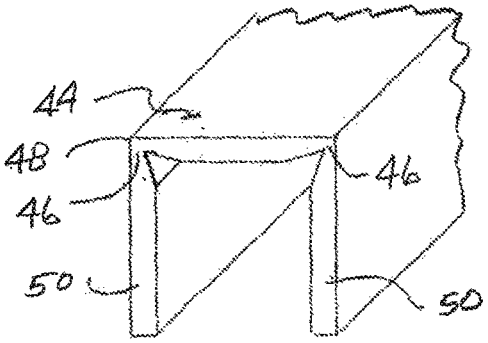
FIG. 6 is an end perspective view of one form of channel member showing one form of attachment means in accordance with one aspect of the present invention.

FIG. 6 is an end perspective view of still another form of channel 44 that is provided with narrowed cross-sections 46 at corners 48 between the base portion 44*a* and the sides 50. This design facilitates breaking away one or more sides 50 of the channel 44 so that the channel can be formed into an L-shape for outer frame members where one side of a frame member abuts against a building structure such as shown for the frame member 12 in FIG. 1. The reduced cross-section at the joint between the base and side is designed to break cleanly along the longitudinal extent of the channel member to form a clean edge for abutting the building structure. Since this channel 44 would not likely have lateral structural strength, it is expected that the channel would be attached to frame members by use of adhesive, tape or hook and loop material.

Figure 7:
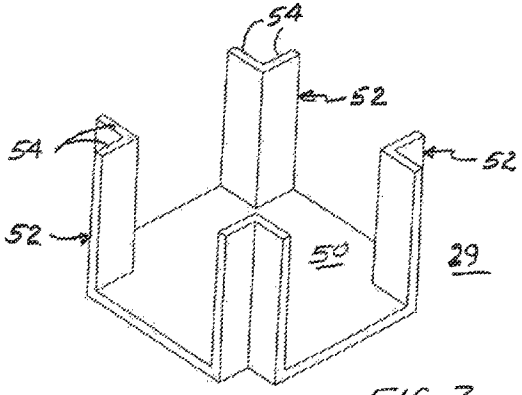
FIG. 7 is a perspective view of one form of connector used to cover ends of the channel members.
Figure 8A:
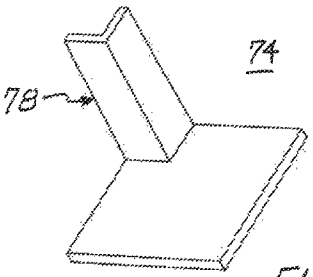
FIGS. 8A and 8B are perspective views of other forms of the connector of FIG. 7 used where frame members intersect edges of windows.
Figure 8B:
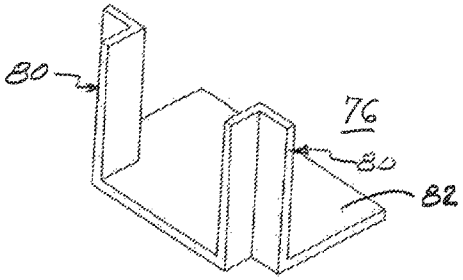

As shown in FIG. 2A, one method of forming the joints for the inventive channels at the intersections of window frame members is to utilize a separate overlaying connector 29 that conceals the ends of the channel members 26, 28. FIG. 7 is a bottom perspective view of one form of connector 29 having a generally flat, rectangular plate-like member 50 having four depending legs 52 extending respectively from four corners of the member 50. Each of the legs 52 are formed as L-shaped in cross section having perpendicular segments 54 designed to fit snugly against sides of the channels when the connector 29 is positioned over one of the intersections of the window frame members 22,24 with the channels 26,28 installed. Preferably, the legs 54 are uniform in size and thickness to create a generally decorative appearance. Considering FIG. 2A in conjunction with FIG. 7, it can be seen that the vertical frame member 24 in the illustrative embodiment is continuous through the intersection with the horizontal frame member 22 comprising the frame member segments 22*a* and 22*b* (a reversal of the frame member arrangement of FIG. 2). It will be appreciated that the selection of which frame member is to be continuous at any junction depends on the particular design of the display window and such selection is not a part of the present invention.

In FIG. 2A, the end of frame member 22*a* and the abutting side of frame member 24 is indicated by dashed line 60 while the end of frame member 22*b* and its abutting side of frame member 24 is indicated by dashed line 62. An end of channel member 26*a* is shown as dashed line 64 and the end of channel member 26*b* is shown as dashed line 66. Dashed lines 68, 70 indicate the ends of channel members 28*a*, 28*b*, respectively. The generally flat plate member 50 is sized such that the depending legs 52, see FIG. 7, fit snugly into the corners where the channel members 26*a*, 26*b*, 28*a*, 28*b* terminate. Accordingly, the connector 29 covers all of the joints formed at the intersections of the channel members. The connector 29 may be attached to the frame members in the same manner as the channel members, e.g., by using double sided tape under the plate member 50 to hold the connector to the frame. In circumstances where the length of the legs 52 may be too long for the depth of the frame members, the ends of the legs may be ground off or cutoff with a saw for the correct length since the connector is formed of a plastic material such as a polycarbonate.

While the intersecting joint shown in FIGS. 2 and 2*a* is the more complicated joint in a commercial display window, there are other joints that present similar issues of concealment. For example, along the perimeter of the window there are junctions where the horizontal and vertical frame members terminate into an edge member. The edge members (not shown) only have two exposed faces and can be covered by an L-shaped channel member. Such L-shaped members may be supplied in combination with the U-shaped channel members or may be formed by breaking or cutting off one of the sides of a U-shaped channel member. FIG. 6 illustrates one form of channel member 44 that is formed with corners 48 having narrowed cross-sections that allow the side members 50 to be bent and broken away from the member 44 so as to form an L-shaped cover for an edge frame member. The resulting L-shaped cover member can then be cut to length and installed over the window edge frame members using adhesive or double sided tape in the same manner as with the channel members. Where the frame members join to the edge members, the joint may be covered or concealed by use of the connectors 74 or 76 shown in FIGS. 8A and 8B, respectively. The connector 74 is essentially a corner cover that would be used where two edge frame members connect so that only a single leg 78 is needed to cover the joint where two L-shaped channel members meet. The connector 76 is designed to conceal a joint where a frame member 22 or 24 meet an edge member (not shown) so that two corners are desired to be concealed. Thus, the connector 76 has two depending legs 80 and is sized to fit snugly about a single frame member such that the base 82 is positioned to conceal the ends of the channel members positioned over the frame members.

It will be apparent that various modifications and adaptations may be made to the channel members and associated connector arrangements described above without departing from the spirit and scope of the invention. It is intended therefore that the appended claims be construed to cover all such modifications and adaptations as fall within the true spirit and scope of the following claims.

What is claimed is:

1. An apparatus for reviving an appearance of a frame structure in a window having a plurality of glass panes supported by a plurality of vertical frame members and a plurality of horizontal frame members in which at least one vertical frame member intersects at least one horizontal frame member, the apparatus comprising:

a plurality of U-shaped members, each U-shaped member being pressed on and removably attached to a corresponding one frame member, the plurality of U-shaped members comprising:

a first U-shaped member being sized to fit over a corresponding one horizontal frame member and having a first length which extends between each intersection of the corresponding one horizontal frame member with two vertical frame members so as to form a snug fitting structure over exposed surfaces of the corresponding horizontal frame member; and a second U-shaped member being sized to fit over a corresponding one vertical frame member and having a second length which extends between each intersection of the corresponding one vertical frame member with two horizontal frame members so as to form a snug fitting structure over exposed surfaces of the corresponding vertical frame member;

a plurality of connectors, each connector comprising a flat plate and at least one depending corner leg extending from the plate, the flat plate being configured to cover over adjacent ends of adjacent U-shaped members at a joint formed at a respective one intersection between intersecting vertical and horizontal frame members; and wherein each U-shaped member comprises a longitudinal base and a pair of opposite lateral sides depending therefrom, each of the sides including a plurality of fins formed along an inner surface thereof for gripping the frame member when the U-shaped member is installed thereon.

2. The apparatus of claim 1 wherein each U-shaped member affixed to any one frame member is affixed by hook and loop fastening material.

3. The apparatus of claim 1 wherein:

some of the horizontal frame members are horizontal edge frame members; and some of the vertical frame members are vertical edge frame members wherein the horizontal edge frame members and the vertical edge frame members define an outer perimeter of the frame structure;

the frame structure further comprises:

a plurality of first edge intersections between of the horizontal edge frame members and the vertical edge frame members;

a plurality of second edge intersections between of the horizontal frame members and the vertical edge frame members; and a plurality of third edge intersections between the vertical frame members and the horizontal edge frame members;

said each U-shaped member of the plurality of U-shaped members is defined by a longitudinally extending base and a pair of opposing sides, and wherein at least one joint between the base and a side is formed with a reduced cross-sectional thickness to allow the side to be readily detachable from the base.

4. The apparatus of claim 3 wherein said each U-shaped member affixed to any one frame member is affixed by double sided tape.

5. The apparatus of claim 1 wherein the flat plate concealing the joint and the at least one corner leg comprises a plurality of corner legs depending from corners of the flat plate for concealing the adjacent ends of the adjacent U-shaped members.

6. The apparatus of claim 5 wherein each of the plurality of corner legs is uniform in cross-section.

7. The apparatus of claim 5 wherein the plate and the U-shaped members are constructed of an extruded plastic material.

8. The apparatus of claim 7 wherein the plastic material is a polycarbonate.

9. The apparatus of claim 1 wherein the plurality of U-shaped members and the plurality of connectors are attached to the frame members with strips of double-sided tape.

10. The apparatus of claim 9 wherein the double-sided tape is positioned in engagement with an inner surface of a base of the U-shaped member.

11. The apparatus of claim 1 wherein each U-shaped member comprises a longitudinal base and a pair of opposite lateral sides depending therefrom, each of the sides including a flexible element for engaging a window pane supported by the frame members, each flexible element forming a seal between the window pane and the U-shaped member along the extent of the U-shaped member.

12. The apparatus of claim 1 wherein each of the U-shaped members is defined by a longitudinally extending base and a pair of opposing sides, and wherein at least one joint between the base and a side is formed with a reduced cross-sectional thickness to allow the side to be readily detachable from the base.

13. The apparatus of claim 1 wherein at least some of the frame members terminate at an edge member of the window, and wherein the plurality of connectors including a respective one edge connector having at least one leg for covering ends of the U-shaped members terminating at the window edge.

14. The apparatus of claim 13 wherein the U-shaped members are formed of pre-colored polycarbonate.

15. The apparatus of claim 1 wherein the frame members include grooves to support glass sheets forming the glass panes.

16. An apparatus for reviving an appearance of a frame structure in a window having a plurality of glass panes supported by a plurality of vertical frame members and a plurality of horizontal frame members in which at least one vertical frame member intersects at least one horizontal frame member, the apparatus comprising:

a plurality of U-shaped members, each U-shaped member being pressed on and removably attached to a corresponding one frame member, the plurality of U-shaped members comprising:

a first U-shaped member being sized to fit over a corresponding one horizontal frame member and having a first length which extends between each intersection of the corresponding one horizontal frame member with two vertical frame members so as to form a snug fitting structure over exposed surfaces of the corresponding horizontal frame member; and a second U-shaped member being sized to fit over a corresponding one vertical frame member and having a second length which extends between each intersection of the corresponding one vertical frame member with two horizontal frame members so as to form a snug fitting structure over exposed surfaces of the corresponding vertical frame member;

a plurality of connectors, each connector comprising a flat plate and at least one depending corner leg extending from the plate, the flat plate being configured to cover over adjacent ends of adjacent U-shaved members at a joint formed at a respective one intersection between intersecting vertical and horizontal frame members; and a plurality of fins formed along an inner surface of the pair of opposite lateral sides for gripping the frame member when the U-shaped member is installed thereon;

wherein each U-shaped member comprises a longitudinal base and a pair of opposite lateral sides depending therefrom, each of the sides including a flexible element for engaging a window pane supported by the frame members, each flexible element forming a seal between the window pane and the U-shaped member along the extent of the U-shaped member.

17. The apparatus of claim 16 wherein the flat plate concealing the joint and the at least one corner leg comprise a plurality of corner legs depending from corners of the flat plate for concealing the adjacent ends of the adjacent U-shaped members.

18. The apparatus of claim 16 wherein each U-shaped member comprises a longitudinal base and a pair of opposite lateral sides depending therefrom, each of the sides including a flexible element for engaging a window pane supported by the frame members, each flexible element forming a seal between the window pane and the U-shaped member along the extent of the U-shaped member.

19. The apparatus of claim 16 wherein each of the U-shaped members is defined by a longitudinally extending base and a pair of opposing sides, and wherein at least one joint between the base and a side is formed with a reduced cross-sectional thickness to allow the side to be readily detached from the base to change any one U-shaped member to an L-shaped member for attachment to one of the horizontal frame member and the vertical frame member along a perimeter of the frame structure.

20. The apparatus of claim 16 wherein at least some of the frame members terminate at an edge member of the window, and wherein the plurality of connectors including a respective one edge connector having at least one leg for covering ends of the U-shaped members terminating at the window edge.

* * * * *